US011008973B2

(12) United States Patent
Perr et al.

(10) Patent No.: US 11,008,973 B2
(45) Date of Patent: May 18, 2021

(54) ENGINE COOLING SYSTEM INCLUDING COOLED EXHAUST SEATS

(71) Applicant: CUMMINS INC., Columbus, IN (US)

(72) Inventors: Andrew P. Perr, Columbus, IN (US); Robin J. Bremmer, Columbus, IN (US); Philipe F. Saad, Columbus, IN (US); Akintomide K. Akinola, Whiteland, IN (US); Rick Vaughan Lewis, Jr., Franklin, IN (US); Dennis King Chan, Bloomington, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/486,645

(22) PCT Filed: Feb. 22, 2018

(86) PCT No.: PCT/US2018/019099

§ 371 (c)(1),
(2) Date: Aug. 16, 2019

(87) PCT Pub. No.: WO2018/156682

PCT Pub. Date: Aug. 30, 2018

(65) Prior Publication Data

US 2020/0232414 A1 Jul. 23, 2020

Related U.S. Application Data

(60) Provisional application No. 62/463,228, filed on Feb. 24, 2017.

(51) Int. Cl.
*F02F 1/40* (2006.01)
*F01P 3/02* (2006.01)
(Continued)

(52) U.S. Cl.
CPC ..... *F02F 1/40* (2013.01); *F01L 3/04* (2013.01); *F01L 3/18* (2013.01); *F01L 3/22* (2013.01); *F01P 3/02* (2013.01); *F01P 2003/024* (2013.01)

(58) Field of Classification Search
CPC ..... F02F 1/40; F02F 1/36; F02F 1/10; F01P 3/14; F01L 2810/01; F01L 3/12
See application file for complete search history.

(56) References Cited

U.S. PATENT DOCUMENTS 4,169,488 A 10/1979 Goloff et al.
4,522,161 A 6/1985 Slee
(Continued)

FOREIGN PATENT DOCUMENTS

CN 107143430 A 9/2017
DE 32 05 676 9/1982
(Continued)

OTHER PUBLICATIONS

International Search Report and Written Opinion from corresponding PCT Application No. PCT/US2018/019099, dated May 8, 2018, pp. 1-10.
(Continued)

*Primary Examiner* — Long T Tran
(74) *Attorney, Agent, or Firm* — Foley & Lardner LLP

(57) ABSTRACT

A cooling system for a cylinder head of an internal combustion engine includes a cylindrical seat configured to engage an exhaust valve, a first coolant jacket, and a first conduit. The exhaust valve seat defines an annular cooling passage extending along a circumference of the cylindrical seat. A wall of the cylindrical seat defines a first opening into the annular cooling passage and a second opening into the annular cooling passage, where the first opening is positioned diametrically opposite to the second opening. The
(Continued)

first coolant jacket is positioned adjacent to a fire-deck of the internal combustion engine. The first conduit fluidly couples the first coolant jacket to the at least one of the first opening and the second opening to the annular cooling passage in the exhaust valve seat.

18 Claims, 6 Drawing Sheets

(51) Int. Cl.

| | |
|---|---|
| ***F01L 3/04*** | (2006.01) |
| ***F01L 3/18*** | (2006.01) |
| ***F01L 3/22*** | (2006.01) |

(56) References Cited

U.S. PATENT DOCUMENTS

| | | | | |
|---|---|---|---|---|
| 4,593,655 | A | 6/1986 | Mezger | |
| 4,941,436 | A | 7/1990 | Beer et al. | |
| 7,063,051 | B2 | 6/2006 | Schellhase | |
| 8,151,743 | B2 | 4/2012 | Reustle | |
| 8,596,239 | B2 | 12/2013 | Escriva et al. | |
| 2002/0124815 | A1* | 9/2002 | Ishiguro | F02F 1/38 123/41.82 R |
| 2011/0220043 | A1 | 9/2011 | Escriva et al. | |
| 2015/0007792 | A1 | 1/2015 | Farooqui et al. | |
| 2015/0211408 | A1* | 7/2015 | Maier | F02F 1/38 123/41.77 |
| 2016/0084194 | A1* | 3/2016 | Green | F02F 1/4235 123/41.74 |
| 2016/0108850 | A1 | 4/2016 | Poschl et al. | |
| 2016/0195035 | A1* | 7/2016 | Poschl | F01P 3/16 123/41.77 |

FOREIGN PATENT DOCUMENTS

| | | |
|---|---|---|
| DE | 43 28 904 | 4/1994 |
| DE | 10 2004 027 084 | 12/2005 |
| DE | 10 2014 100 841 | 7/2014 |
| DE | 10 2014 012 807 | 3/2016 |
| EP | 0 186 888 A1 | 7/1986 |
| EP | 2 082 119 A1 | 7/2009 |
| GB | 0 668 962 | 3/1952 |
| GB | 2 101 212 | 1/1983 |
| JP | 56-004611 | 1/1981 |
| JP | 58-023214 | 2/1983 |
| JP | 58-050708 | 3/1983 |
| JP | 60-026110 | 2/1985 |
| WO | WO-2014/180661 A1 | 11/2014 |

OTHER PUBLICATIONS

Supplementary EP Search Report for EP Application No. 18758508.8, dated Nov. 11, 2020.

* cited by examiner

ENGINE COOLING SYSTEM INCLUDING COOLED EXHAUST SEATS

CROSS-REFERENCE TO RELATED PATENT APPLICATIONS

The present application is the U.S. national stage of PCT Application No. PCT/US2018/019099, filed Feb. 22, 2018, which claims priority to and benefit of U.S. Provisional Patent Application No. 62/463,228, filed Feb. 24, 2017 and entitled "Engine Cooling System Including Exhaust Seats," the entire disclosures of which are incorporated herein by reference.

TECHNICAL FIELD

The present disclosure relates to internal combustion engine systems.

BACKGROUND

Systems using internal combustion engines often use cylinder-head cooling systems to provide cooling to various engine components. The cylinder-head cooling systems include coolant passages that allow flow of an engine coolant to facilitate transfer of heat away from the cylinder-head and the engine.

SUMMARY

In one set of embodiments, a cooling system for a cylinder head of an internal combustion engine includes a cylindrical seat configured to engage an exhaust valve, a first coolant jacket, and a first conduit. The exhaust valve seat defines an annular cooling passage extending along a circumference of the cylindrical seat. An outer wall of the cylindrical seat defines a first opening into the annular cooling passage and a second opening into the annular cooling passage. The first coolant jacket is positioned adjacent to a fire-deck of the cylinder head. The first conduit fluidly couples the first coolant jacket to the at least one of the first opening and the second opening to the annular cooling passage in the exhaust valve seat.

In one or more implementations, the annular cooling passage defines two coolant flow paths between the first opening and the second opening. In one or more implementations, the two coolant flow paths are of substantially equal length. In one or more implementations, the first opening is positioned diametrically opposite to the second opening along the circumference of the cylindrical seat. In one or more implementations, the first conduit fluidly couples a portion of the first coolant jacket positioned proximate an intake-exhaust bridge of the cylinder head to the first opening. In one or more implementations, the cooling system includes a second coolant jacket, and a second conduit fluidly coupling the second coolant jacket to the second opening.

In another set of embodiments, a method comprises providing a cylinder head of an internal combustion engine. The cylinder head comprises a cylindrical seat configured to engage an exhaust valve. The cylindrical seat defines an annular cooling passage extending along a circumference of the cylindrical seat. The cylindrical seat also defines a first opening and a second opening in a wall of the cylindrical seat into the annular cooling passage. A first coolant jacket is positioned adjacent to a fire-deck of the cylinder head. The first coolant jacket is fluidly coupled to at least one of the first opening and the second opening via a first conduit. The annular cooling passage is configured to receive a coolant for cooling the cylinder head.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, inventive internal combustion assemblies and methods of operating internal combustion assemblies. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Figure 1:
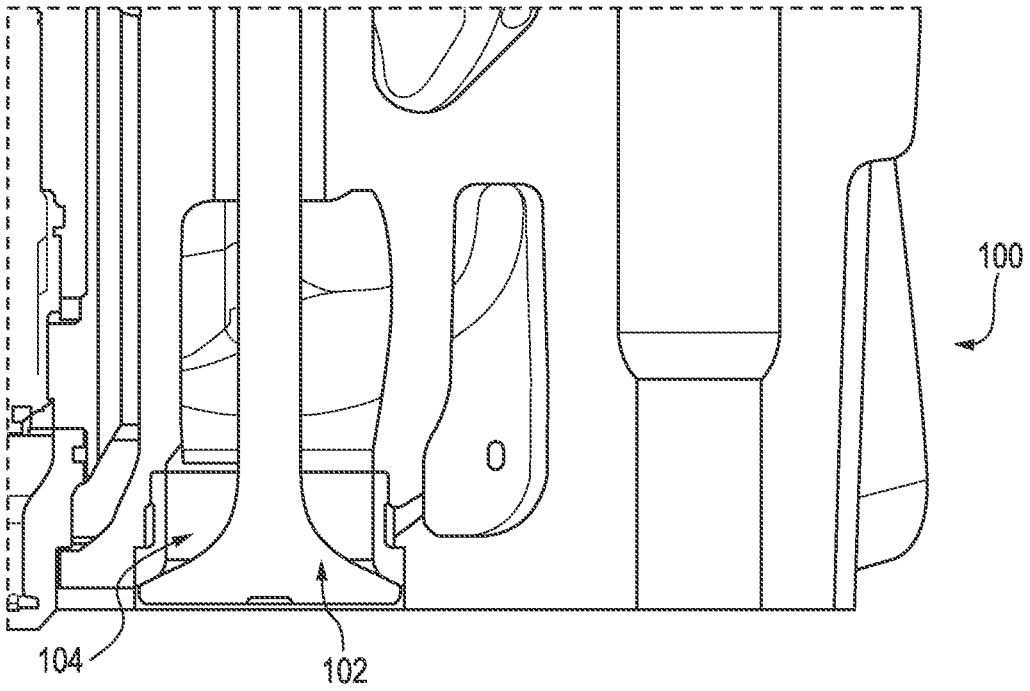
FIG. 1 shows a cross-sectional representation of a cylinder head of an internal combustion engine.

FIG. 1 shows a cross-sectional representation of a cylinder head 100 of an internal combustion engine. In particular, FIG. 1 shows a cross-sectional representation of a portion of the cylinder head 100 that includes an exhaust valve 102 and an exhaust valve seat 104. The cylinder head 100 is positioned above a cylinder block (not shown), which defines a number of cylinders. The cylinder head 100 covers the cylinders to form combustion chambers. The exhaust valve 102 is positioned over one of these combustion chambers. The exhaust valve 102 is operationally coupled to an exhaust valve operation mechanism, such as, for example, a mechanism including a cam-shaft and a spring, causing the exhaust valve 102 to reciprocate along its longitudinal axis. The motion of the exhaust valve 102 reciprocates between two positions. In a first position, the exhaust valve 102 rests against the exhaust valve seat 104, which defines an opening into an exhaust manifold. In this position, the exhaust valve 102 closes the opening into the exhaust manifold, thereby preventing gases within the combustion chamber from escaping through the exhaust manifold. In a second position, the exhaust valve 102 extends inwards into the combustion chamber and away from the exhaust valve seat 104. In this position, the opening into the exhaust manifold is not blocked by the exhaust valve 102, thereby allowing gases within the combustion chamber to escape through the exhaust manifold.

While not shown in FIG. 1, the cylinder head 100 also can include one or more intake valves, which either block or allow air or an air-fuel mixture to enter the combustion chamber. The cylinder head 100 can include one or more intake valve operation mechanisms associated with the one or more intake valves. The cylinder head 100 also can include intake valve seats corresponding to the intake valves. The intake valve seats can be configured in a manner similar to the exhaust valve seats 104. The timing and the range of motion of the exhaust valve 102 and the intake valve can be determined based on the particular design of the engine.

Due to the combustion of fuel within the engine, the cylinder head 100 can be exposed to high temperature gases. In particular, the exhaust valve 102 and the exhaust valve seat 104 are exposed to high temperature exhaust gases. This exposure to high temperatures can, over time, cause deterioration of the exhaust valve 102 and the exhaust valve seat 104. Deterioration of the exhaust valve 102 and the exhaust valve seat 104 can, in turn, result in decrease in the performance or even failure of the internal combustion engine. The cylinder head 100 can include a cooling system to provide cooling to various components of the engine. For example, a cooling system can include several cavities called water jackets or coolant jackets through which a coolant flows to provide cooling to various components of the engine. These cooling jackets can provide cooling to the exhaust valve seat 104 and the exhaust valve 102, thereby reducing or mitigating the deterioration of the exhaust valve and the exhaust valve seat 104 due to exposure to high temperatures.

Figure 2:
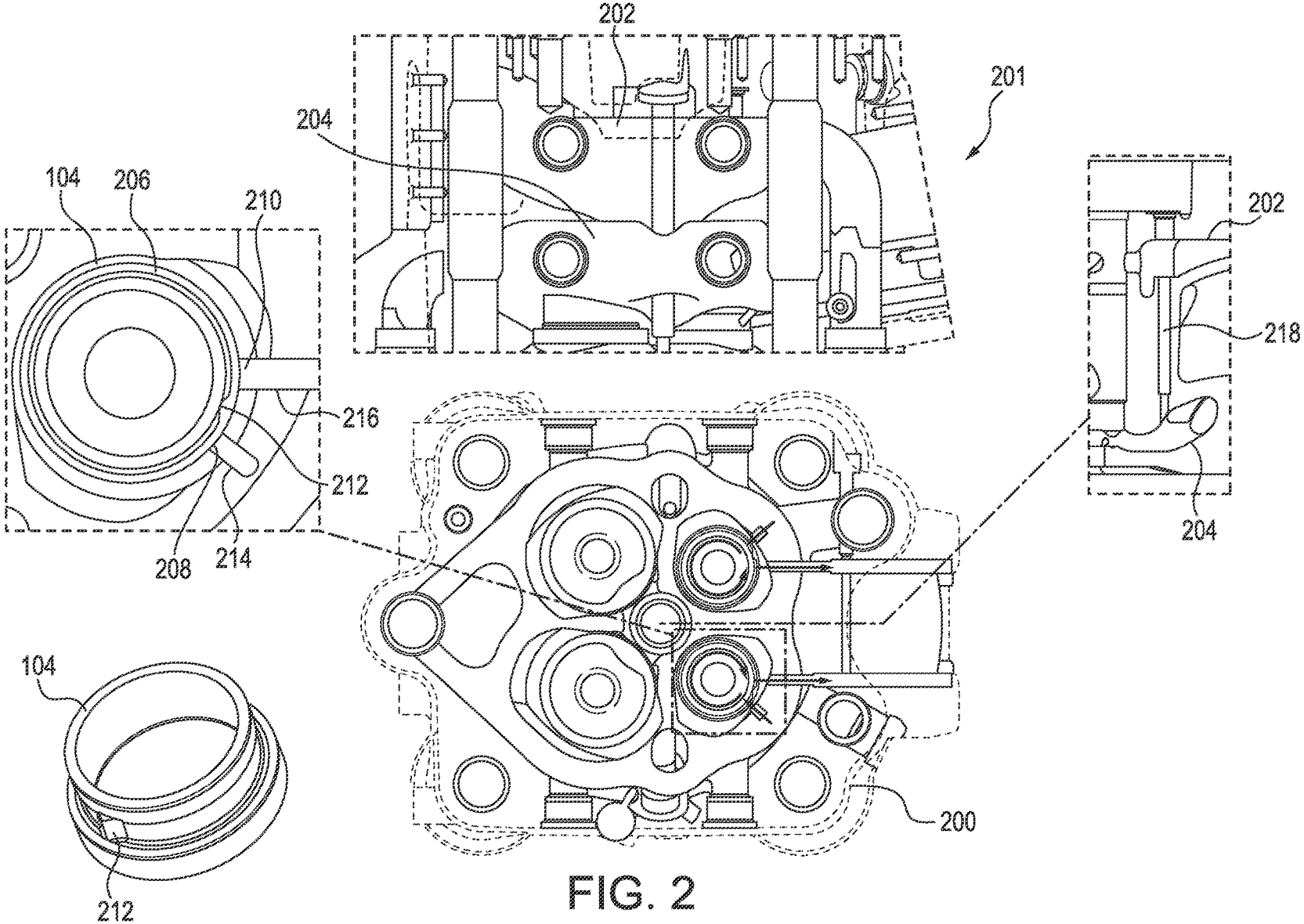
FIG. 2 depicts a representation of a cylinder head including a cooling system.

FIG. 2 depicts a representation of a cylinder head 200 including a cooling system 201. The cooling system 201 includes two cooling jackets: an upper coolant jacket 202 and a lower coolant jacket 204. The upper coolant jacket 202 and the lower coolant jacket 204 include several input and output ports which allow the flow of a coolant in and out of the respective cooling jacket. In one or more embodiments, the coolant can include water, a solution of water and antifreeze or corrosion inhibitors, and other liquid or gaseous coolants. The input and output ports in the upper and the lower coolant jackets 202 and 204 can receive and send coolant to other cooling jackets in the engine, such as cooling jackets in the cylinder block. The input and output ports may also receive and send the coolant between the upper and the lower coolant jackets 202 and 204. The lower coolant jacket 204 can be located adjacent to a fire-deck, which can refer to a lower surface of the cylinder head 200 that is adjacent to, or couples with, a cylinder block of the internal combustion engine.

The cooling system 201 also includes cooling channels within the exhaust valve seats, such as the exhaust valve seat 104 discussed above in relation to FIG. 1 above. For example, as shown in the expanded view in FIG. 2, the exhaust valve seat 104 can include an annular channel 206 along a circumference of the valve seat through which the coolant can be circulated. The annular channel 206 can include an input orifice 208 and an output orifice 210 through which the coolant may enter and exit, respectively. In some implementations, the input and output orifices 208 and 210 can be fluidly coupled to the upper coolant jacket 202 or the lower coolant jacket 204. The input and the output orifices 208 and 210 can be positioned about 60 degrees apart with respect to a center of the exhaust valve seat 104. The exhaust valve seat 104 also can include a partition 212 within the annular channel 206 and positioned between the input and the output orifices 208 and 210. The partition 212 impedes coolant flow from the input orifice 208 to the output orifice 210 via a shortest path within the annular channel 206, thereby forcing the coolant to travel over a longer path around the annular channel 206. For example, the coolant can enter the input orifice 208, and travel about 300 degrees around the annular channel before exiting the output orifice 210.

As mentioned above, the input and output orifices 208 and 210 are fluidly coupled to the upper and the lower coolant jackets 202 and 204. For example, the input orifice 208 is fluidly coupled to the lower coolant jacket 204 via an input conduit 214, and the output orifice 210 is fluidly coupled to the upper coolant jacket 202 via an output conduit 216. Thus, the coolant in the lower coolant jacket 204 is directed to the annular channel 206 via the input conduit 214 and the input orifice 208. The coolant is made to circulate along the annular channel through a longer path between the input orifice 208 and the output orifice 210, and directed to the upper conduit via the output conduit 216.

Additional conduits can also be provided to direct the coolant between the upper coolant jacket 202 and the lower coolant jacket 204. For example, as shown in cross-sectional view of the cooling system 201, an inter jacket conduit 218 fluidly connects the upper coolant jacket 202 with the lower coolant jacket 204. The inter-jacket conduit 218 is fluidly connected to an opening in a portion of the lower coolant jacket 204 located between two exhaust seats (also referred to as an E-E bridge). The inter-jacket conduit 218 directs the coolant from the E-E bridge to the upper coolant jacket 202. The cooling system 201 also can include additional inter-jacket conduits (not shown) that can direct the coolant between the lower and the upper coolant jackets 204 and 202.

In some example implementations, the exhaust valve seat 104 including the annular channel 206 in may increase the complexity of manufacturing the internal combustion engine. For example, in some instances, appropriately aligning the input and the output conduits 214 and 216 with the input and output orifices 208 and 210, respectively, can involve additional alignment steps in the manufacture of the internal combustion engine. These additional alignment steps can increase the time and cost of manufacturing. In addition, the annular channel 206 may provide inadequate cooling of the exhaust valve seat 104 because the partition 212 limits the coolant circulation to only about 300 degrees of the circumference of the exhaust valve seat 104. Furthermore, the partition 212 and the annular channel 206 undesirably result in high coolant pressure. In addition, the inter jacket conduit 218 directs coolant away from the E-E bridge. This can cause inadequate cooling of the E-E bridge, which is exposed to relatively high temperatures due to the proximity to two exhaust valves. The cooling system discussed below in relation to FIGS. 3-5 is configured to address the abovementioned issues associated with the cooling system 201.

Figure 3:
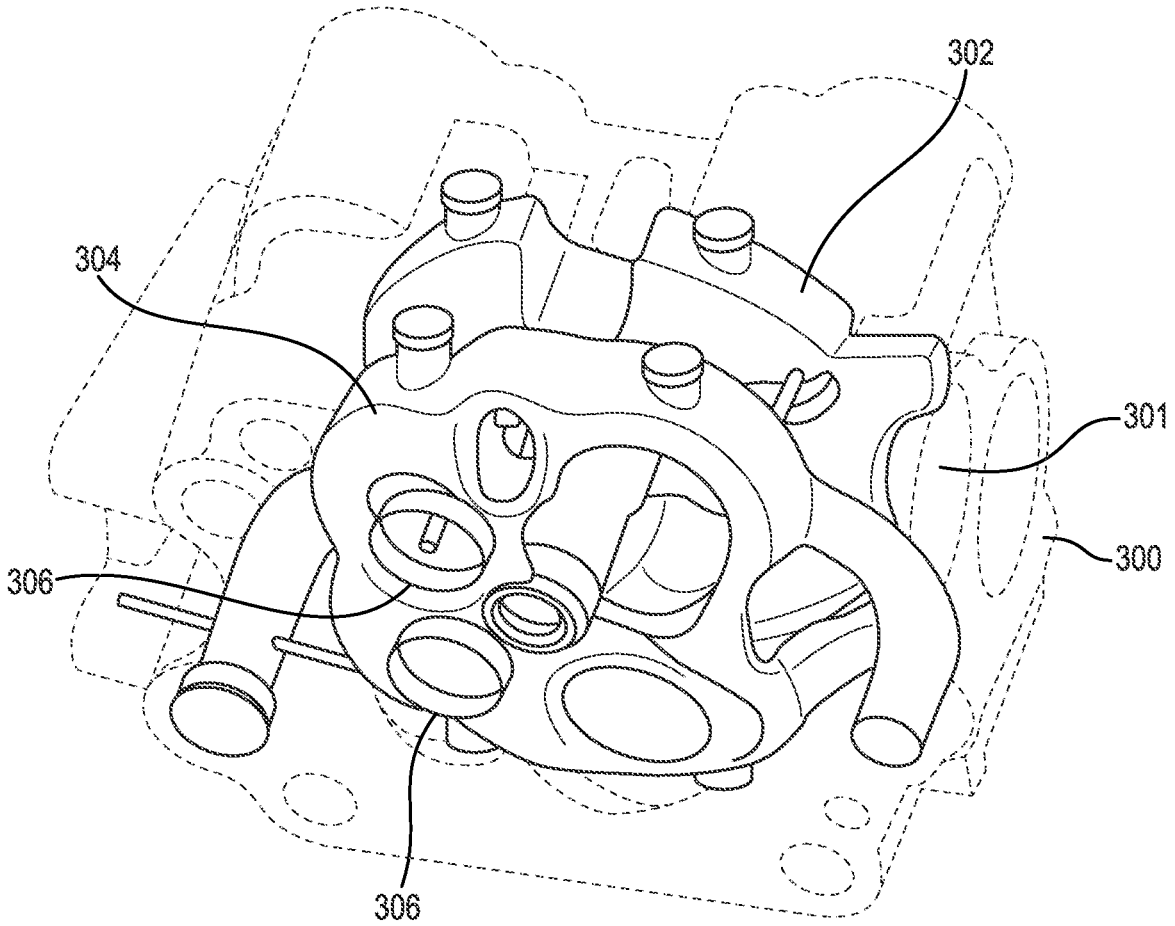
FIG. 3 depicts a representation of a cylinder head of an internal combustion engine including a cooling system, according to an embodiment of the present disclosure.

FIG. 3 depicts a representation of a cylinder head 300 of an internal combustion engine including a cooling system 301. The cooling system 301, similar to the cooling system 201 shown in FIG. 2, includes an upper coolant jacket 302 and a lower coolant jacket 304. Also, similar to the cooling system 201, which includes annular channels 206 in the exhaust valve seat 104, the cooling system 301 also includes annular channels 306. However, unlike the annular channels 206 shown in FIG. 2, the annular channels 306 shown in FIG. 3 do not include a partition 212. Instead, the annular channel 306 is unobstructed throughout the circumference of the exhaust seat (not shown).

Figure 4:
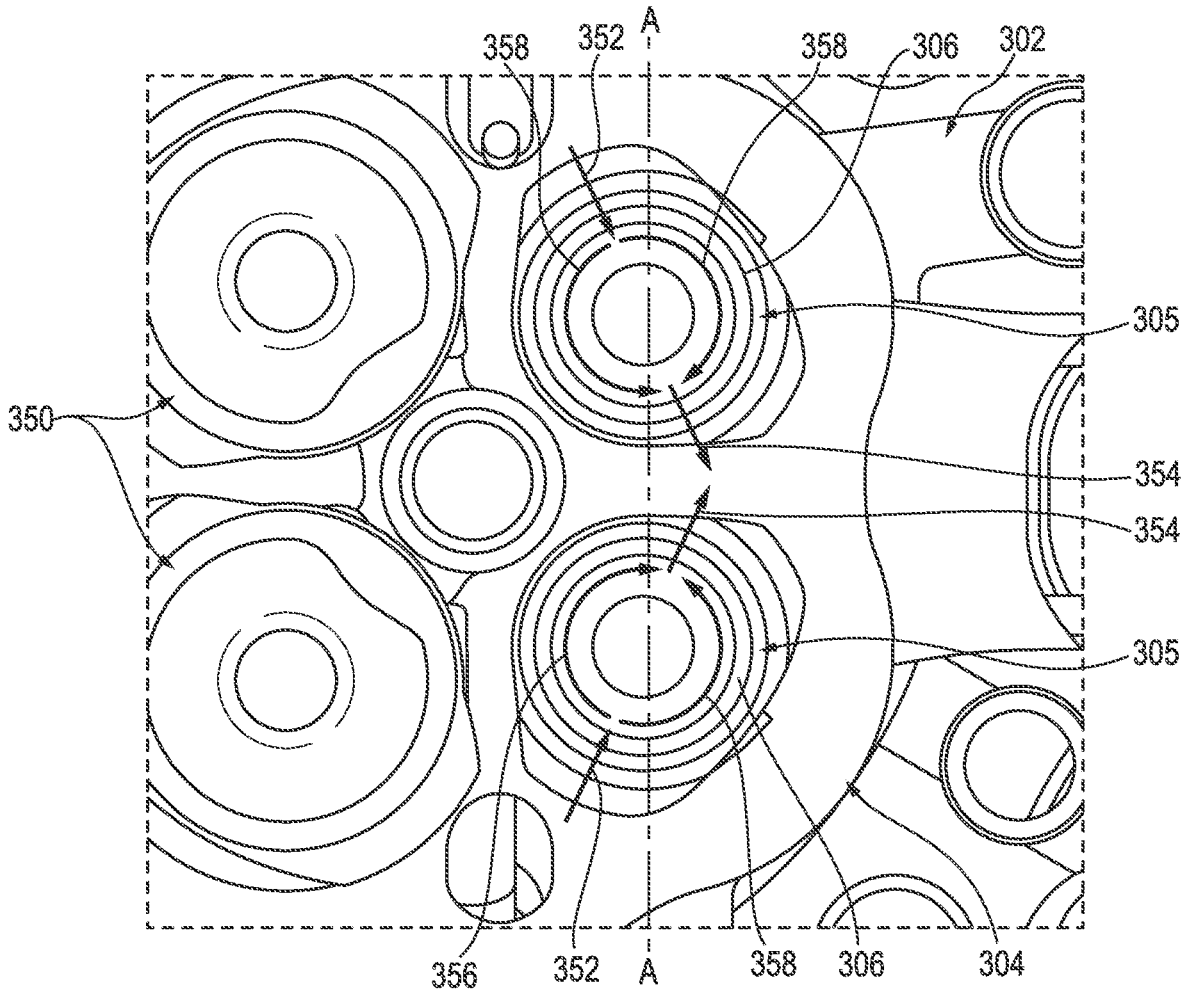
FIG. 4 depicts an expanded top view of the cylinder head shown in FIG. 3.
Figure 5:
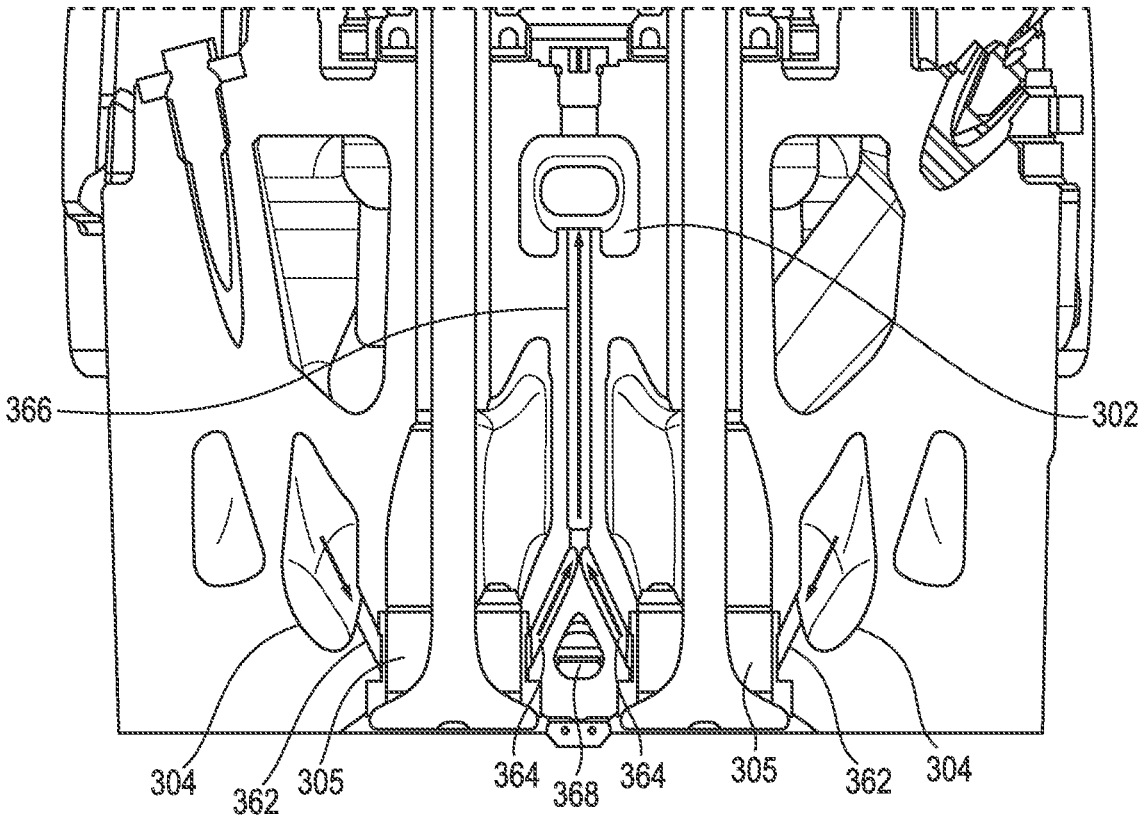
FIG. 5 depicts a cross-sectional representation the cylinder head shown in FIG. 4.

FIG. 4 depicts an expanded top view of the cylinder head 300 shown in FIG. 3. In particular, FIG. 4 shows the cooling system 301 including an annular channel 306 associated with each of two exhaust valve seats 305. The two exhaust valve seats 305 are positioned adjacent to two intake valve seats 350, which engage with respective intake valves (not shown). Each exhaust valve seat 305 includes the annular channel 306 that extends along the circumference of the respective exhaust valve seat 305. The exhaust valve seat 305 includes an input orifice (not shown) through which a coolant can enter the annular channel 306, and includes an output orifice (not shown) through which the coolant can exit the annular channel 306. In one or more example implementations, the input orifice and the output orifice can be positioned diametrically opposite to each other along the annular channel 306. For example, as shown in FIG. 4, the coolant can enter the annular channel 306 via the input orifice, which is located at a position indicated by the first arrow 352; and can exit the annular channel 306 via the output orifice, which is located at a position indicated by the second arrow 354. In some implementations, the input and the output orifice can be positioned such that they form an angle of about 180 degrees with the center of the annular channel 306. In some implementations, the input or output orifices can be formed on an inner wall of the exhaust valve seat 305.

The coolant, after entering the annular channel 306 through the input orifice, is directed through two paths in the annular channel 306 before exiting through the output orifice. For example, a portion of the coolant can be directed via a first path indicated by the first path arrow 356, and the remainder of the coolant can be directed via a second path indicated by the second path arrow 358. The coolant directed through both the first path and the second path through the annular channel 306 is directed out of the annular channel 306 via the output orifice. The combined length of the first and the second paths covers the entire circumference of the annular channel 306. That is, the coolant can be circulated through the entire 360 degrees of the annular channel 306. This is in contrast with the annular channel 206 of the exhaust seat 104 shown in FIG. 2, in which the partition 212 limited the circulation of the coolant to about 300 degrees around the annular channel 206. The 360 degrees circulation of coolant around the exhaust valve seat 305 provides an improvement in the performance of the cooling system 301. In some implementations, the lengths of the first and the second paths can be equal.

FIG. 5 depicts a cross-sectional representation along an axis A-A of the cylinder head 300 shown in FIG. 4. FIG. 5 shows two exhaust valve seats 305, each including the annular channel 306 shown in FIG. 4. Each exhaust valve seat 305 is fluidly coupled to the lower coolant jacket 304 via an input conduit 362. Each input conduit 362 is fluidly coupled to the respective exhaust valve seat 305 via an input orifice of the respective annular channel 306. Each exhaust valve seat 305 is also fluidly coupled to the upper coolant jacket 302 via an output conduit 364 and in upper jacket conduit 366. In particular, the output conduits 364 extend from each exhaust valve seat 305 and merge into one end of the upper jacket conduit 366. The other end of the upper jacket conduit 366 is fluidly coupled to the upper coolant jacket 302. The coolant is directed from the lower coolant jacket 304 into each of the exhaust valve seats 305 via their respective input conduits 362. The coolant is then directed via two paths (shown in FIG. 4 by the first path arrow 356 and the second path arrow 358) along the annular channel 306 in each exhaust valve seat 305. The coolant is directed out of each exhaust valve seat 305 via the respective output conduit 364, and into the upper coolant jacket 302 via the upper jacket conduit 366. In one or more implementations, directing the coolant through the two paths in the annular channel 306 can result in a decrease in a coolant pressure within the cooling system 301.

The cooling system 301 shown in FIG. 5 also avoids directing coolant away from the E-E bridge 368, which is exposed to high temperatures. In particular, the coolant directed towards the upper coolant jacket 302 is supplied by the coolant in the exhaust valve seats 305. Unlike the cooling system 201 shown in FIG. 2, where the coolant directed to the upper coolant jacket 202 is provided by the E-E bridge, in the cooling system 301 shown in FIGS. 3-5, the E-E bridge 368 is bypassed, thereby avoiding removing coolant from this region of the cylinder head. As a result, the E-E bridge is provided improved cooling. In some implementations, the coolant towards the upper coolant jacket 302 can be directed from an opening in the lower coolant jacket 304 positioned near an I-E bridge, which refers to a region of the cylinder head between an intake valve seat and an exhaust valve seat. For example, referring to FIG. 4, openings in the lower coolant jacket 304 located at a position near a bridge between the exhaust valve seat 305 and the intake valve seat 350 can be used to direct coolant from the lower coolant jacket 304 to the upper coolant jacket 302. As the I-E bridge is exposed to temperatures that are relatively lower than the temperatures the E-E bridge is exposed to, the impact of removing the coolant from the I-E bridge is relatively less than the impact on removing the coolant from the E-E bridge 368.

In some implementations, the exhaust valve seat 305 can include two or more input orifices. In some such implementations, the cooling system 301 can include corresponding number of input conduits for fluidly coupling the lower coolant jacket 304 to the annular channel 306 via the two or more input orifices. Similarly, the exhaust valve seat 305 can include two or more output orifices. In some such implementations, the cooling system 301 can include a corresponding number of output conduits for fluidly coupling the annular channel 306, via the two or more output orifices, to the upper jacket conduit 366 or directly to the upper coolant jacket 302. In some implementations, the two or more input orifices can be positioned diametrically opposite to the two or more output orifices. In some implementations, the two or more input orifices can be arranged co-linearly in a direction along the longitudinal axis of the exhaust valve seat 305. Similarly, the two or more output orifices also can be arranged co-linearly in a direction along the longitudinal axis of the exhaust valve seat 305.

Figure 6:
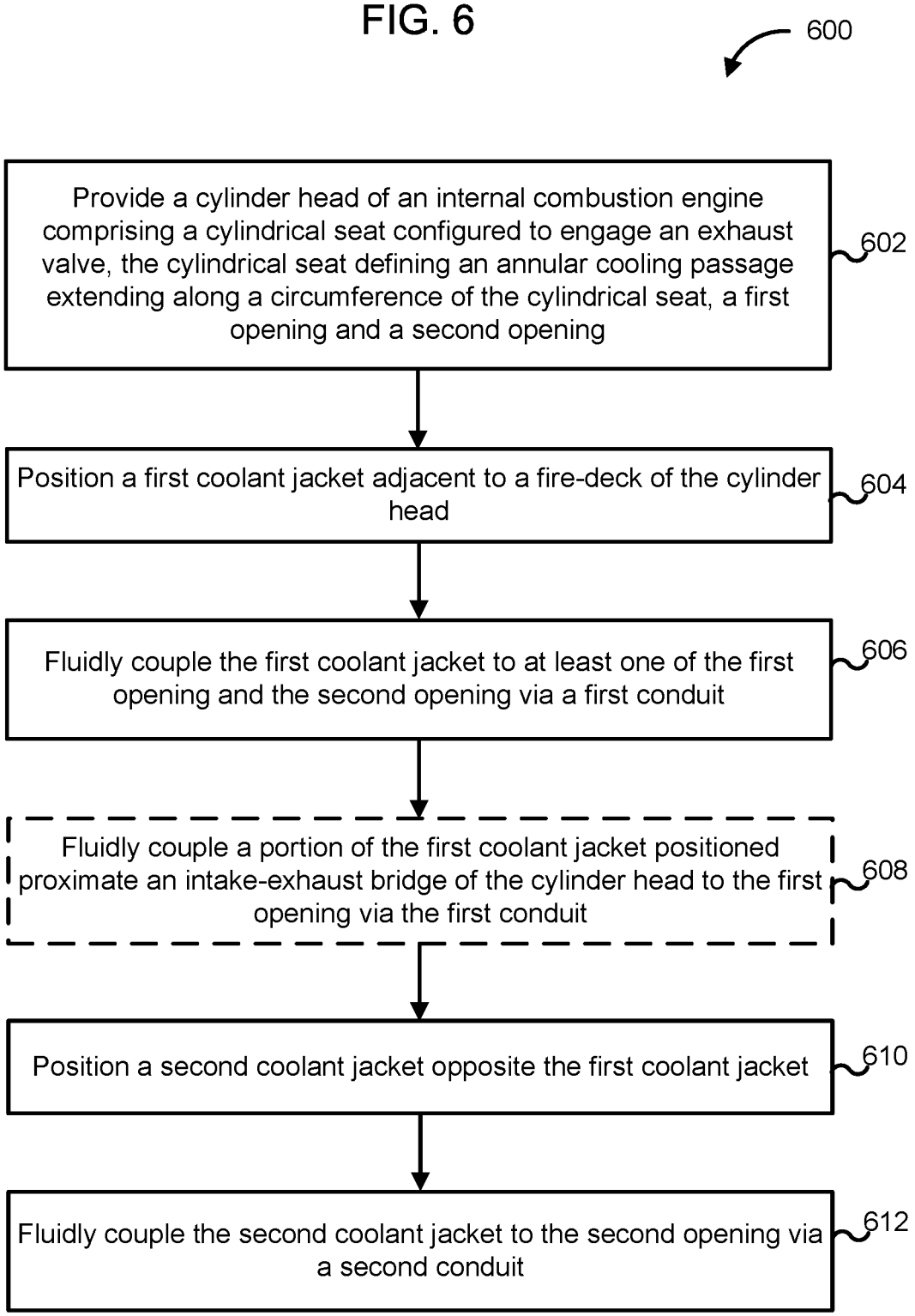
FIG. 6 is a schematic flow diagram of providing a cooling system in a cylinder head, according to an embodiment.

FIG. 6 is a schematic flow diagram of a method 600 for providing a cooling system (e.g., the cooling system 301) in a cylinder head (e.g., the cylinder head 200, 300). The method 600 comprises providing a cylinder head of an internal combustion engine, at 602. The cylinder head comprises a cylindrical seat configured to engage an exhaust valve. For example, the cylinder head 300 comprising the exhaust valve seat 305 is provided.

The cylindrical seat defines an annular cooling passage extending along a circumference of the cylindrical seat. For example, the exhaust valve seat 305 defines the annular channel 306 extending around the exhaust valve seat 305. The cylindrical seat also defines a first opening and a second opening in a wall of the cylindrical seat into the annular cooling passage. For example, exhaust valve 305 defines the input orifice through which a coolant can enter the annular channel 306, as well as an output orifice through which the coolant can exit the annular channel 306 (e.g., in an outer wall or an inner wall thereof).

The annular cooling passage (e.g., the annular channel 306) may define two coolant flow paths (e.g., the first path 356 and the second path 358) between the first opening and the second opening. In some embodiments, the two coolant flow paths may be of substantially equal length. In other embodiments, the first opening is positioned diametrically opposite to the second opening along the circumference of the cylindrical seat.

In various embodiments, the cylindrical seat defines plurality of first openings in the wall of the cylindrical seat (e.g., the exhaust valve seat 305) into the annular cooling passage (e.g., the annular channel 306). A corresponding plurality of second openings may also be defined into the annular cooling passage (e.g., the annular channel 306). In particular embodiments, the plurality of first openings may be positioned co-linearly in a direction along the longitudinal axis of the cylindrical seat (e.g., the exhaust valve seat 305), and the corresponding plurality of second openings may also be positioned co-linearly in a direction along the longitudinal axis of the cylindrical seat (e.g., the exhaust valve seat 305).

At 604, a first coolant jacket is positioned adjacent to a fire-deck of the cylinder head. At 606, the first coolant jacket is fluidly coupled to at least one of the first opening and the second opening via a first conduit. For example, the lower coolant jacket 304 is positioned proximate to a fire-deck of the cylinder head 300, and is fluidly coupled to an input orifice of the respective annular channel 306 via the input conduit 362. In particular embodiments, the method 600 also comprises fluidly coupling a portion of the first coolant jacket (e.g., the lower coolant jacket 304) positioned proximate an intake-exhaust bridge of the cylinder head (e.g., the cylinder head 300) to the first opening via the first conduit (e.g., the input conduit 362), at 608. The annular cooling passage is configured to receive a coolant for cooling the cylinder head.

In some embodiments, the method 600 also comprises positioning a second coolant jacket opposite the first coolant jacket, at 610. At 612, the second coolant jacket is fluidly coupled to the second opening. For example, the upper coolant jacket 302 is positioned opposite the lower coolant jacket 304, and is fluidly coupled to the second opening via the upper jacket conduit 368. The second coolant jacket (e.g., the upper coolant jacket 302) may receive the coolant from the first cooling jacket (e.g., the lower cooling jacket 304) via the second opening.

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that, unless otherwise noted, any parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. A cooling system for a cylinder head of an internal combustion engine, comprising:

a cylindrical seat configured to engage an exhaust valve, the cylindrical seat defining an annular cooling passage extending along a circumference of the cylindrical seat; a wall of the cylindrical seat defining a first opening into the annular cooling passage and a second opening into the annular cooling passage;

a first coolant jacket disposed entirely above a combustion chamber, the first coolant jacket positioned adjacent to a fire-deck of the cylinder head;

a first conduit fluidly coupling the first coolant jacket to at least one of the first opening and the second opening;

a second coolant jacket disposed entirely above the combustion chamber, the second coolant jacket positioned opposite the first coolant jacket; and a second conduit fluidly coupling the second coolant jacket to the second opening.

2. The cooling system of claim 1, wherein the annular cooling passage defines two coolant flow paths between the first opening and the second opening.

3. The cooling system of claim 2, wherein the two coolant flow paths are structured to cooperatively allow a coolant to travel an entire path length of the annular cooling passage.

4. The cooling system of claim 2, wherein the two coolant flow paths are of substantially equal length.

5. The cooling system of claim 1, wherein the first opening is positioned diametrically opposite to the second opening along the circumference of the cylindrical seat.

6. The cooling system of claim 1, wherein the wall comprises an outer wall of the cylindrical seat, the first opening and the second opening formed in the outer wall.

7. The cooling system of claim 1, wherein the wall comprises an inner wall of the cylindrical seat, the first opening and the second opening formed in the inner wall.

8. The cooling system of claim 1, wherein the wall of the cylindrical seat defines a plurality of first openings into the annular cooling passage, and wherein the wall further defines a corresponding plurality of second openings into the annular cooling passage.

9. The cooling system of claim 8, further comprising a corresponding plurality of first conduits fluidly coupling the first coolant jacket to the annular cooling passage via at least one of the plurality of first openings and the plurality of second openings.

10. The cooling system of claim 8, wherein the plurality of first openings are positioned co-linearly in a direction along the longitudinal axis of the cylindrical seat, and wherein the corresponding plurality of second openings are also positioned co-linearly in a direction along the longitudinal axis of the cylindrical seat.

11. The cooling system of claim 1, wherein the first conduit fluidly couples a portion of the first coolant jacket positioned proximate an intake-exhaust bridge of the cylinder head to the first opening.

12. A method, comprising:

providing a cylinder head of an internal combustion engine, the cylinder head comprising a cylindrical seat configured to engage an exhaust valve, the cylindrical seat defining an annular cooling passage extending along a circumference of the cylindrical seat, the cylindrical seat further defining a first opening and a second opening in a wall of the cylindrical seat into the annular cooling passage;

positioning a first coolant jacket adjacent to a fire-deck of the cylinder head, the first coolant jacket disposed entirely above a combustion chamber; and fluidly coupling the first coolant jacket to at least one of the first opening and the second opening via a first conduit;

positioning a second coolant jacket opposite the first coolant jacket, the second coolant jacket disposed entirely above the combustion chamber; and fluidly coupling the second coolant jacket to the second opening via a second conduit, wherein the annular cooling passage is configured to receive a coolant for cooling the cylinder head.

13. The method of claim 12, wherein the annular cooling passage defines two coolant flow paths between the first opening and the second opening.

14. The method of claim 12, wherein the two coolant flow paths are of substantially equal length.

15. The method of claim 12, wherein the first opening is positioned diametrically opposite to the second opening along the circumference of the cylindrical seat.

16. The method of claim 12, wherein the cylindrical seat defines a plurality of first openings in the wall of the cylindrical seat into the annular cooling passage and a plurality of second openings into the annular cooling passage.

17. The method of claim 16, wherein the plurality of first openings are positioned co-linearly in a direction along the longitudinal axis of the cylindrical seat, and wherein the corresponding plurality of second openings are also positioned co-linearly in a direction along the longitudinal axis of the cylindrical seat.

18. The method of claim 12, further comprising fluidly coupling a portion of the first coolant jacket positioned proximate an intake-exhaust bridge of the cylinder head to the first opening via the first conduit.

* * * * *